United States Patent [19]

Schäfer et al.

[11] 4,229,176

[45] Oct. 21, 1980

[54] PROCESS FOR PREVENTING OLIGOMER DEPOSITS ON DYED POLYESTER TEXTILE MATERIAL

[75] Inventors: Paul Schäfer, Riehen; Heinz Abel, Reinach, both of Switzerland

[73] Assignee: Ciba-Geigy Corporation, Ardsley, N.Y.

[21] Appl. No.: 931,579

[22] Filed: Aug. 7, 1978

[30] Foreign Application Priority Data

Aug. 10, 1977 [CH] Switzerland ..... 9800/77

[51] Int. Cl.[2] ..... D06P 1/18; D06P 1/16; D06P 1/64; D06P 5/02

[52] U.S. Cl. ..... 8/582; 8/476; 8/594

[58] Field of Search ..... 8/73, 92, 169, 173

[56] References Cited

U.S. PATENT DOCUMENTS

| | | | |
|---|---|---|---|
| 3,752,649 | 8/1973 | Smerz et al. | 8/137 |
| 3,864,077 | 2/1975 | Popp et al. | 8/173 |
| 4,060,387 | 11/1977 | Baumann et al. | 8/169 |

FOREIGN PATENT DOCUMENTS

| | | | |
|---|---|---|---|
| 2403859 | 8/1975 | Fed. Rep. of Germany | 8/173 |
| 2412427 | 10/1975 | Fed. Rep. of Germany | 8/92 |
| 963902 | 7/1964 | United Kingdom . | |

*Primary Examiner*—Joseph L. Schofer
*Assistant Examiner*—Maria S. Tungol
*Attorney, Agent, or Firm*—Edward McC. Roberts

[57] ABSTRACT

A process for preventing oligomer deposits on dyeings produced on textile material consisting of or containing polyester fibers, which process comprises applying to said material during or after dyeing a phthalic acid ester of the formula

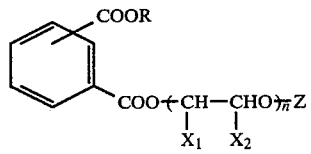

(1)

wherein

R is alkyl or alkenyl of 6 to 22 carbon atoms, $X_1$ and $X_2$, is hydrogen or methyl and the other is hydrogen, Z is hydrogen or alkyl of 1 to 4 carbon atoms, and n is 1 to 4.

16 Claims, No Drawings

PROCESS FOR PREVENTING OLIGOMER DEPOSITS ON DYED POLYESTER TEXTILE MATERIAL

The present invention relates to a process for dyeing or aftertreating polyester fibres, wherein visible oligomer deposits and oligomer abrasion are avoided or greatly diminished by using particularly suitable phthalic acid esters.

Oligomers which consist of up to more than 90% by weight of the cyclic trimer are usually formed in the manufacture of polyester fibres. During dyeing under high temperature conditions, for example at 110°-140° C., the oligomers migrate to the surface of the fibres or into the dyebath and crystallise out, especially on cooling, whereupon they then form further deposits partly on the surface of the fibres and partly on the walls of the dyeing machines. As the oligomers are only insufficiently dyeable, they remain as visible crystals on the surface of the fabric. As a consequence, problems arise during the further processing of the fibres, for example in spinning, twisting, warping, knitting and weaving. The crystals adhering to the surface of the fibres increase the frictional resistance and cause, for example, filament ruptures. Fibres dyed under high temperature conditions also exhibit an increased abrasion, which becomes unpleasantly apparent (dust, deposits) wherever the fibres come in contact with guide devices, in other words when they are subjected to mechanical stress.

According to German Offenlegungsschrift No. 2,403,859, the formation of oligomer deposits during the dyeing of polyester fibres at temperatures above 130° C. can be avoided by carrying out the dyeing in the presence of phthalic acid diesters of aliphatic or araliphatic monoalcohols containing 6 to 10 carbon atoms. However, the resulting dyed fibres have an increased soilability, especially to dry dirt.

Suitable phthalic acid esters have now been found which simultaneously overcome the above oligomer problems and have a less adverse effect on the soiling behaviour of the fabric.

Accordingly, the present invention provides a process for preventing oligomer deposits on textile material consisting of or containing polyester fibres, which comprises applying to said material, during or after the dyeing procedure, a phthalic acid ester of the formula

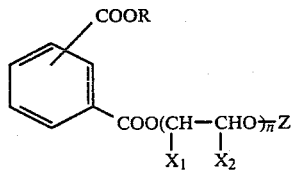

(1)

wherein

R represents alkyl or alkenyl each containing 6 to 22, preferably 12 to 18, carbon atoms, one of $X_1$ and $X_2$ represents hydrogen or methyl and the other represents hydrogen, Z represents hydrogen or alkyl of 1 to 4 carbon atoms, especially methyl or ethyl, and n is 1 to 4, preferably 2 or 3.

The phthalic acid ester of the formula (1) is preferably applied during the dyeing of the polyester fibres.

The ester group —COOR can be in the o-, m- or p-position. It is preferably in the ortho-position and thus forms the o-phthalic acid diester. However, the corresponding terephthalic acid diesters are also particularly preferred.

In formula (1) R preferably represents alkyl of 8 to 22, preferably 12 to 18, carbon atoms, and each of $X_1$ and $X_2$ is hydrogen. Z is in particular hydrogen.

Alkyl radicals R are for example n-hexyl, n-octyl, 2-ethylhexyl, n-decyl, n-dodecyl, myristyl, n-hexadecyl, n-heptadecyl, n-octadecyl or behenyl. Alkenyl radicals R are for example decenyl, dodecenyl, hexadecenyl or oleyl.

The esters of the formula (1) are partly known compounds and can be obtained by known methods. For example, they can be obtained by reacting orthophthalic, isophthalic or terephthalic acid, or especially phthalic anhydride, with an alcohol of the formula (2)

and with an optionally monoetherified diol of the formula

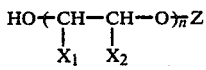

(3)

wherein R, $X_1$, $X_2$, Z and n have the given meanings.

If phthalic anhydride is used, the esterification is advantageously carried out stepwise, preferably first with the monoalcohol R—OH and then with the diol of the formula (3).

Both individual alcohols of the formulae (2) and (3) and mixtures thereof can be employed.

The higher aliphatic alcohols of the formula (2) are for example water-insoluble aliphatic monoalcohols containing preferably 8 to 22 carbon atoms. These alcohols can be saturated or unsaturated and branched or straight chain. They can be employed singly or in admixture. It is possible to employ natural aliphatic alcohols, for example lauryl, myristyl, cetyl, oleyl, stearyl, arachyl or behenyl alcohol, or synthetic aliphatic alcohols, such as in particular 2-ethylhexanol, as well as trimethyl-hexanol, trimethyl nonylalcohol, hexadecyl alcohol, or the alfols. The alfols are linear primary alkanols. The number following the name indicates the average number of carbon atoms which the alcohol contains. Some representatives of these alfols are alfol (8-10), alfol (10-14), alfol (16-18) and alfol (20-22).

Preferably, alkanols containing 12 to 18 carbon atoms are employed. Of these, stearyl alcohol and alfol (10-14) are particularly preferred.

Suitable diols of the formula (3) are in particular ethylene glycol, 1,2-propylene glycol, diethylene glycol or oligoethylene glycol having an average molecular weight of 150 to 194. Diethylene glycol is preferred. $C_1$-$C_4$ monoalkyl ethers of the diols of the formula (3), especially ethylene glycol monomethyl or monoethyl ether, diethylene glycol monomethyl or monoethyl ether, can also be used with success.

The esterification of the phthalic acid with the alcohols of the formulae (2) and (3) is advantageously carried out with a solvent or in a solvent which is inert to the reactants, for example benzene, toluene, chlorobenzene or nitrobenzene, preferably at 80° to 120° C., whilst the condensed water can be removed by distillation. This esterification reaction can be catalysed by adding catalytic amounts of strong acids, for example sulphuric acid or p-toluenesulphonic acid.

Depending on their composition, i.e. depending on the ratio of the hydrophilic group of the lipophilic group, the eligible phthalic acid esters of the present invention are soluble or emulsifiable. Ordinarily it is possible to prepare 30 to 60% aqueous solutions or emulsions. The emulsions can contain conventional additives, for example emulsifiers or wetting agents. Suitable emulsifiers are for example acid esters, for example phosphoric acid esters or, in particular, sulphuric acid esters, of adducts of 2 to 12 moles of ethylene oxide and/or propylene oxide with alcohols containing 8 to 22 carbon atoms, with phenylphenols or in particular with alkyl phenols containing 4 to 16 carbon atoms in the alkyl moiety. These esters can be in the form of free acids or especially of ammonium or alkali metal salts.

Typical representatives of the eligible phthalic acid esters of the present invention having the formulae (4)

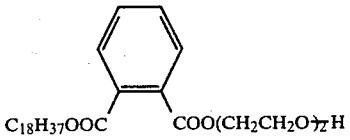

(5)

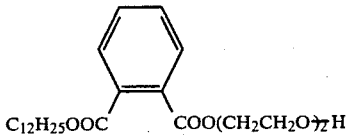

(6)

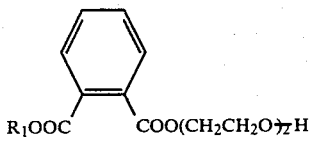

$R_1$ = radical of alfol 10–14.

(7)

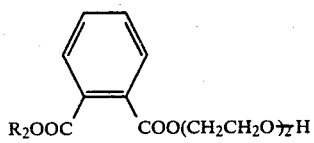

$R_2$ = radical of alfol 16–18.

(8)

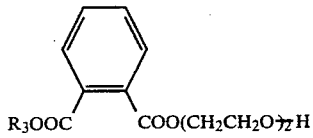

$R_3$ = radical of the mixture consisting of 80% by weight of alfol 16–18 and 20% by weight of alfol 10–14.

(9)

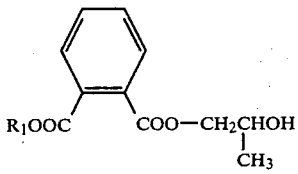

$R_1$ = radical of alfol 10–14.

-continued (10)

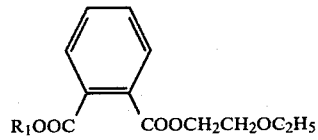

$R_1$ = radical of alfol 10–14.

(11)

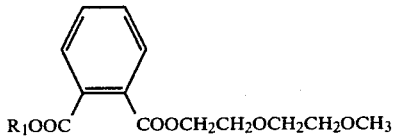

$R_1$ = radical of alfol 10–14.

(12)

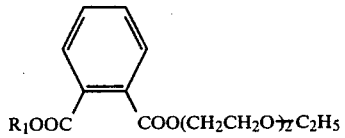

$R_1$ = radical of alfol 10–14.

(13)

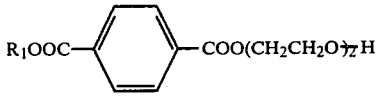

$R_1$ = radical of alfol 10–14.

The amounts in which the phthalic acid esters are employed in the process of the present invention vary advantageously between 0.1 and 5 g, preferably between 1 and 3 g, per liter of aqueous dye or aftertreatment liquor.

Suitable polyester material is in particular fibrous material made from linear polyesters which are obtained for example by polycondensation of terephthalic acid with ethylene glycol or of isophthalic acid or terephthalic acid with 1,4-bis-(hydroxymethyl)cyclohexane, or copolymers of terephthalic and isophthalic acid and ethylene glycol. Polyethylene terephthalate fibres are preferred.

The fibrous materials can be used as blends with one another or with other fibres, for examples blends of polyacrylonitrile/polyester, polyamide/polyester, polyester/viscose and polyester/wool.

The fibrous material can be in the most widely different stages of processing, for example in the form of flocks, tow, yarns, knitted fabrics, such as piece goods or knits, of nonwovens or wovens.

The polyester fibrous material is advantageously dyed with disperse dyes. Suitable disperse dyes for the process of the present invention are those known in the art for dyeing fibrous material made from linear polyesters. Such dyes ordinarily are sparingly soluble in water and do not contain any water-solubilising groups and are present in the dyebath in the form of a fine dispersion.

These dyes can belong to a very wide variety of classes, for example acridone dyes, nitro dyes, methine and polymethine dyes, oxazine dyes, perinone dyes, aminonaphthoquinone dyes, cumarin dyes and, in particular, anthraquinone dyes and azo dyes, such as monoazo and disazo dyes. Mixtures of such dyes can also be used.

The eligible phthalic acid esters of the present invention can also be used for whitening undyed polyester fibrous material with fluorescent brightening agents which are sparingly soluble in water. These latter can belong to any class of fluorescent brightening agent. In particular they are fluorescent brightening agents of the coumarin, benzocoumarin, pyrazine, pyrazoline, oxazine, triazolyl, benzoxazolyl, benzofurane or benzimidazolyl or naphthalimide series.

The amount of dye added to the dyebath depends on the desired colour strength. In general, amounts of 0.01 to 10% by weight, based on the weight of the fibrous material, are suitable.

In addition to containing the dyes and the oligomer inhibitor, the dyebaths can also contain, if desired, a carrier or carrier mixtures which act as catalysts for dyeing the polyester fibres. Examples of carriers which can be concurrently used are: phenylphenols, benzylphenols, polychlorobenzenes, xylenes, trimethylbenzenes, naphthalenes, diphenyl, diphenyl ethers, dimethyldiphenyl ethers, alkyl benzoates, aryl benzoates, for example phenyl benzoate and 2-ethylphenyl benzoate, and dimethyl phthalate, benzyl alcohol, monochloro-, dichloro- and trichlorophenoxyethanol or -propanol or pentachlorophenoxyethanol.

The dyebaths can contain 0.1 to 10 g/l, advantageously 0.3 to 5 g/l, of the carrier.

The dyebaths can contain mineral acids, such as sulphuric acid or phosphoric acid, organic acids, advantageously lower aliphatic carboxylic acids, such as formic, acetic or oxalic acid and/or salts, such as ammonium acetate, ammonium sulphate or sodium acetate. The acids are used in particular for adjusting the pH value of the dyebaths of the invention, which is as a rule from 4 to 8, preferably from 4.5 to 6.5.

Furthermore, the dyebaths can contain dispersants, preferably anionic or non-ionogenic dispersants. These are employed in particular for obtaining a good dispersion of the disperse dyes. Suitable dispersants are those conventionally employed in dyeing with disperse dyes.

The dyebaths can also contain the customary electrolytes, levelling agents, wetting agents, plasticisers and antifoams. Before it is added to the dyebath, the oligomer inhibitor can, if desired, be dissolved in water or emulsified together with a wetting agent, for example with a mixture of a fatty alkylsulphonate, a fatty alkyl polyalkyl ether and a silicone antifoam, or also with acid esters of ethylene oxide adducts with alkyl phenols.

Dyeing is advantageously carried out from an aqueous liquor by the exhaustion process, under high temperature conditions (HT dyeing), in closed pressure-resistant machines at temperatures above 106° C., advantageously between 110° and 140° C., preferably between 125° and 135° C., and under pressure. Suitable closed machines are circulation dyeing machines, such as cheese dyeing machines or beam dyeing machines, winch becks, jet dyeing or cylinder dyeing machines, paddles or jiggers.

The liquor ratio can accordingly be chosen within a wide range, for example from 1:4 to 1:100, preferably from 1:10 to 1:50.

The process can be carried out such that the goods are first treated with the oligomer inhibitor and optionally with the carrier and subsequently dyed. The procedure can also be such that the goods are treated simultaneously with the oligomer inhibitor, the dyes and the assistants that may be present.

Preferably the textile material is put into a liquor which contains the oligomer inhibitor and the carrier and has a temperature of 60° to 80° C., and is treated for 5 to 15 minutes at this temperature. The dyes are then added at 60° to 90° C. and the temperature of the bath is slowly raised in order to dye in the temperature range of 110° to 140° C. for 30 to 90, preferably 45 to 60 minutes.

Finally, the liquor is cooled to about 70°–90° C. and the dyed material is rinsed and dried in the conventional manner. If necessary, the dyeing can be subjected to a conventional reduction after-clear.

The aftertreatment of the polyester fibrous material with the ester of the formula (1) is carried out as a rule following the dyeing procedure, which has been effected under high temperature conditions. Preferably the aftertreatment is carried out at a temperature of 50° to 100° C., preferably at 70° to 90° C.

The aftertreatment can advantageously be carried out in conjunction with other operations. For example, the ester of the formula (1) can be added to the alkaline bath in which the polyester dyeings are subjected to a reduction after-clear with sodium hydrogen sulphite, so that it is possible to carry out the reduction after-clear and the aftertreatment with the oligomer inhibitor in a single operation.

With the aid of the process of the present invention it is thus possible to obtain level dyeings in a simple manner when dyeing polyester fibres under high temperature conditions and simultaneously to prevent oligomer deposits both on the textile material and in the dyeing machines. Furthermore, the use of the phthalic acid ester of the present invention has only an insignificant adverse effect on the soilability of the fibrous material. The action of the phthalic acid esters of the formula (1) resides in the fact that the oligomers are partly emulsified yet partly remain bonded on the fibres.

The material dyed by the process of the present invention is distinguished in addition by diminished abrasion. The avoidance of oligomer deposits and abrasion can be observed in yarns by drawing dyed yarn, after it has been wound off, through a slit in stiff black cardboard. In doing so, the oligomers present on the surface of the yarn are scraped off. The oligomer content can then be visually determined on the basis of the extent and the density of the resulting white mark. The oligomer amount can however also be determined gravimetrically.

The polyester yarns dyed and aftertreated by the process of the present invention can also be better twisted. In particular, the number of filament ruptures is reduced, so that the capacity of the twisting machine is substantially increased. Marked advantages are also evident in spinning, for example polyester tow, as the deleterious abrasion is largely avoided.

A further advantage consists in the fact that the phthalic acid esters of the formula (1) also impart a permanent antistatic and soft-handle effect to the polyester material.

In the following Examples the parts and percentages are by weight.

EXAMPLE 1

100 kg of a polyester knitted fabric, which has previously been cleansed in perchloroethylene at 60° C., is dyed in a beam dyeing machine as follows:

1500 liters of water are heated to 60° C. in a preparing vessel. To this initial bath are then added 3000 g of ammonium sulphate, 200 g of formic acid and 2500 g of the phthalic acid ester of the formula (4). This initial bath is then pumped into the dyeing machine and heated to 80° C., whereupon 6000 g of a benzyl phenol carrier and, after 10 minutes, 4000 g of a dye of the formula

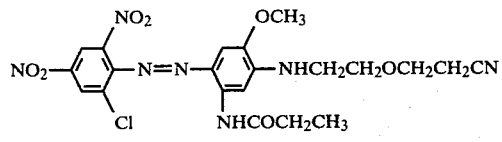

(14)

are added. After a further 10 minutes the temperature is raised to 130° C. in the course of 20 minutes and dyeing is carried out for 60 minutes at this temperature. The dye-bath is cooled to 80° C. and run off from the dyeing machine.

The fabric is subsequently given a reduction after-clear for 20 minutes at 75° C. in the conventional manner (with an aqueous liquor which contains sodium hydrogen sulphite and has been made alkaline with sodium hydroxide). The fabric is then rinsed and dried.

A blue dyeing which contains no oligomer deposit is obtained. If the fabric is dyed in the same manner but without the addition of the phthalic acid ester of the formula (4), then distinct oligomer deposits are visible.

The phthalic acid ester of the formula (4) can be prepared as follows:

With stirring and while introducing nitrogen, 81 g of stearyl alcohol are fused at 100° C. Then 44.4 g of phthalic anhydride are added in portions in the course of 20 minutes such that on each occasion a clear melt is obtained. The melt is kept for 4 hours at 100° C. After addition of 100 g of toluene, 31.8 g of diethylene glycol and 0.4 g of sulphuric acid, the resulting solution is heated to the boil. Then 5.8 g of water are distilled off as an azeotrope in the course of 5 hours. The solution is subsequently cooled to room temperature and, after addition of 4 g of sodium carbonate, stirred for 20 minutes. The precipitated salt is collected by filtration and the solvent is distilled off in vacuo from the filtrate, leaving as residue 152 g of the phthalic acid ester of the formula (4) in the form of a light yellow oil, which congeals to a paste on standing.

EXAMPLE 2

100 kg of polyester yarn in muff form are dyed in a cheese dyeing machine as follows:

1300 liters of water are heated to 60° C. in a preparing vessel. To this initial bath are then added 2600 g of ammonium sulphate 200 g of formic acid (85%)

2000 g of the phthalic acid ester of the formula (5) and 2000 g of a 40% emulsion of trichlorobenzene.

This initial bath is then pumped into the dyeing machine. The liquor flow is periodically reversed, so that it is pumped for about 2 minutes from the inside of the muff to the outside and then for about 3 minutes in the opposite direction. After 15 minutes, 4000 g of the dye of the formula (14) (dispersed beforehand in water of 60° C.) are added to the dyeing machine. The temperature is subsequently raised to 130° C. in the course of 30 minutes and dyeing is carried out for 60 minutes at this temperature. After the dyebath has cooled to 90° C. it is run off from the apparatus. The yarn is then given an aftertreatment for 20 minutes at 80° to 90° C. with a liquor of the following composition:

1300 liters of water of 90° C.

6500 g of sodium hydroxide solution (30%)

1300 g of sodium bisulphite.

The fabric is thoroughly rinsed with warm and cold water. A level, fast, blue dyeing is obtained. The examination for oligomer deposits is carried out by drawing the yarn through the slit of a stiff sheet of paper. Any oligomers which have deposited onto the surface of the yarn are scraped off and collected on the paper. The results of the examination carried out on yarn dyed in the above liquor show that no oligomers have been scraped off, but that there is a marked oligomer deposit when the yarn is dyed in a liquor that does not contain the phthalic acid ester of the formula (5).

The phthalic acid ester of the formula (5) is obtained in accordance with the manufacturing direction of Example 1, except that the stearyl alcohol is replaced by 55.8 g of lauryl alcohol, Yield: 128 g of a light yellow oil.

EXAMPLE 3

The procedure of either Example 1 or 2 is repeated, replacing the phthalic acid ester of the formula (4) or (5) by twice the amount of a preparation consisting of 47 parts of the phthalic acid ester of the formula (6), 3 parts of the ammonium salt of the acid phosphoric acid ester of the adduct of 9 moles of ethylene oxide with 1 mole of nonyl phenol, and 50 parts of water. Level, blue dyeings which contain no oligomer deposits are likewise obtained.

EXAMPLE 4

The procedure of Example 1 or 2 is repeated, replacing the phthalic acid ester of the formula (4) or (5) by twice the amount of a preparation consisting of 40 parts of the phthalic acid ester of the formula (6), 10 parts of the ammonium salt of the acid sulphuric acid ester of the adduct of 2 moles of ethylene oxide with 1 mole of 40% nonyl phenol, and 50 parts of water. Level, blue dyeings which contain no oligomer deposits are likewise obtained.

EXAMPLE 5

The procedure of Example 1 or 2 is repeated, replacing the phthalic acid ester of the formula (4) or (5) by the same amount of a phthalic acid ester of the formula (9), (10), (11), (12) or (13). Level, blue dyeings which contain no oligomer deposits are likewise obtained.

The phthalic acid esters of the formulae (9) to (12) can be obtained in accordance with the manufacturing direction of Example 1, but replacing the diethylene glycol used therein by 22.8 g of propylene glycol, 27 g of ethylene glycol monoethyl ether, and 36 g of diethylene glycol monomethyl ether or 40.2 g of diethylene glycol monoethyl ether. The phthalic acid ester of the formula (13) can be obtained as follows: With stirring and while introducing nitrogen, a mixture of 58.2 g of dimethyl terephthalate, 57 g of alfol 1014, 31.8 g of diethylene glycol, 0.08 g of anhydrous calcium acetate and 0.16 g of antimony trioxide is heated to 170° C. Then 20 $cm^3$ of methanol are distilled off in the course of 11 hours at 170° C. to 200° C. The residue is allowed to cool, affording 128 g of a colourless paste which contains 91% of the compound of the formula (13).

EXAMPLE 6

100 kg of a polyester woven fabric, which has been dyed as described in Example 1, but without using the phthalic acid ester of the formula (4), and which has been given a reduction after-clear in the conventional manner, are aftertreated in a fresh bath for 20 minutes at 70° C. with 3000 g of the phthalic acid ester of the formula (4). The liquor ratio is 1:15. The fabric is then rinsed and dried. A blue dyeing which contains no oligomer deposits is again obtained.

EXAMPLE 7

100 kg of a polyester woven fabric, which has been dyed as described in Example 1, but without using the phthalic acid ester of the formula (4), are aftertreated with a liquor which contains 5 g/l of 30% sodium hydroxide solution, 3 g/l of sodium hydrogen sulphite, 1 g/l of the adduct of 1 mole of octadecyl diethylene triamine with 18 moles of ethylene oxide, and 3000 g of the phthalic acid ester of the formula (5). The liquor ratio is 1:15. A blue dyeing which contains no oligomer deposits is likewise obtained.

What is claimed is:

1. A process for preventing oligomer deposits on dyeings produced on polyester textile material containing up to 100 polyester fibers, which process comprises applying to said material during or after the dyeing procedure a phthalic acid ester of the formula

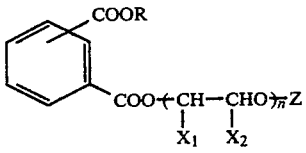

(1)

wherein

R is alkyl or alkenyl of 6 to 22 carbon atoms, one of $X_1$ and $X_2$, is hydrogen or methyl and the other is hydrogen, Z is hydrogen or alkyl of 1 to 4 carbon atoms, and n is 1 to 4.

2. A process according to claim 1 wherein the phthalic acid ester is of the formula

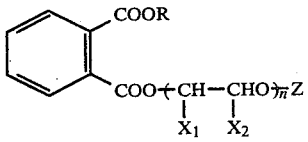

(1a)

wherein R, $X_1$, $X_2$, Z and n having the meanings given in claim 1.

3. A process according to claim 1 wherein z is hydrogen.

4. A process according to claim 1 wherein R is alkyl of 8 to 22 carbon atoms and $X_1$ and $X_2$ are hydrogen.

5. A process according to claim 4 wherein R is alkyl of 12 to 18 carbon atoms.

6. A process according to claim 1 wherein n is 2 or 3.

7. A process according to claim 1, wherein R is octadecyl, Z, $X_1$ and $X_2$ are hydrogen and n is 2.

8. A process according to claim 1 wherein R is dodecyl, $X_1$, $X_2$ and Z are hydrogen and n is 2.

9. A process according to claim 1 wherein R is the hydrocarbon residue of an alfol containing 10 to 14 carbon atoms.

10. A process according to claim 1 wherein the treatment of the textile material with the phthalic acid ester of the formula (1) is carried out during the dyeing procedure.

11. A process according to claim 1 wherein the treatment of the textile material is carried out by the exhaust method during or after dyeing.

12. A process according to claim 11 wherein treatment of the textile material, is carried out during the dyeing procedure at a temperature of 110° to 140° C.

13. A process according to claim 12 wherein dyeing is carried out with disperse dyes.

14. A process according to claim 11 wherein the treatment of the textile material is carried out after the dyeing procedure at a temperature of 50° to 100° C.

15. A process according to claim 14 wherein the aftertreatment is carried out while simultaneously subjecting the dyed textile material to a reduction afterclear.

16. An aqueous liquor for carrying out the process according to claim 1 which contains a disperse dye and a phthalic acid ester of the formula (1).

* * * * *